US009366397B2

(12) United States Patent
Owada

(10) Patent No.: US 9,366,397 B2
(45) Date of Patent: Jun. 14, 2016

(54) SEMICONDUCTOR LIGHT SOURCE APPARATUS

(71) Applicant: Stanley Electric Co., Ltd., Tokyo (JP)

(72) Inventor: Soji Owada, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 351 days.

(21) Appl. No.: 14/157,898

(22) Filed: Jan. 17, 2014

(65) Prior Publication Data

US 2014/0233210 A1 Aug. 21, 2014

(30) Foreign Application Priority Data

Jan. 18, 2013 (JP) ..... 2013-007698

(51) Int. Cl.

| | |
|---|---|
| ***F21K 99/00*** | (2010.01) |
| ***F21V 29/00*** | (2015.01) |
| ***F21V 9/16*** | (2006.01) |
| ***F21V 29/505*** | (2015.01) |
| ***F21V 29/74*** | (2015.01) |
| ***F21S 8/10*** | (2006.01) |
| *F21V 7/04* | (2006.01) |

(Continued)

(52) U.S. Cl.

CPC ..... *F21K 9/56* (2013.01); *F21S 48/1109* (2013.01); *F21S 48/1145* (2013.01); *F21S 48/328* (2013.01); *F21V 9/16* (2013.01); *F21V 29/505* (2015.01); *F21V 29/74* (2015.01); *F21V 7/04* (2013.01); *F21V 7/22* (2013.01); *F21Y 2101/02* (2013.01); *F21Y 2101/025* (2013.01)

(58) Field of Classification Search

CPC ..... F21K 9/56; F21S 48/328; F21S 48/145; F21V 29/505; F21V 29/74; F21V 9/16

See application file for complete search history.

(56) References Cited

U.S. PATENT DOCUMENTS

| | | | |
|---|---|---|---|
| 3,231,746 | A | 1/1966 | Goodrich |
| 5,426,576 | A | 6/1995 | Hewlett |

(Continued)

FOREIGN PATENT DOCUMENTS

| | | | |
|---|---|---|---|
| JP | 2004-55360 | A | 2/2004 |
| JP | 2004-341105 | A | 12/2004 |

(Continued)

OTHER PUBLICATIONS

List of Potentially Related Pending U.S. Appl. No. 12/949,776 to Takashi Sugiyama filed Nov. 18, 2010.

*Primary Examiner* — David V Bruce
(74) *Attorney, Agent, or Firm* — Kenealy Vaidya LLP

(57) ABSTRACT

A semiconductor light source apparatus can emit various color lights having high brightness. The light source apparatus can include a phosphor layer directly disposed on a reflective layer and metallic bumps located between the reflective layer and a radiating substrate. The phosphor layer can be composed of at least one of a glass phosphor and a phosphor ceramic and can include at least one of a yellow phosphor, a red phosphor, a green phosphor and a blue phosphor. The light source can be located adjacent the phosphor layer so that light having high brightness emitted from the light source can be reflected on the reflective layer and heat of the phosphor layer can radiate from the radiating substrate via the metallic bumps. Thus, the disclosed subject matter can provide semiconductor light source apparatuses that can emit various color lights having high brightness, and which can be used for headlight, etc.

20 Claims, 5 Drawing Sheets

(51) Int. Cl.
*F21V 7/22* (2006.01)
*F21Y 101/02* (2006.01)

(56) References Cited

U.S. PATENT DOCUMENTS

| | | | |
|---|---|---|---|
| 5,496,427 | A | 3/1996 | Gustafson et al. |
| 6,830,343 | B2 | 12/2004 | Song |
| 6,861,638 | B2 | 3/2005 | Bacarella et al. |
| 6,883,937 | B2 | 4/2005 | Vastola et al. |
| 7,128,441 | B2 | 10/2006 | Monch |
| 7,461,950 | B2 | 12/2008 | Yamanaka |
| 2005/0269582 | A1 | 12/2005 | Mueller et al. |
| 2005/0285981 | A1 | 12/2005 | Wang et al. |
| 2006/0164606 | A1 | 7/2006 | Bhowmik |
| 2006/0245093 | A1 | 11/2006 | Kao et al. |
| 2007/0064432 | A1 | 3/2007 | Kubo |
| 2008/0180823 | A1 | 7/2008 | Tso et al. |
| 2009/0187234 | A1 | 7/2009 | Meyer et al. |
| 2011/0116253 | A1 | 5/2011 | Sugiyama |
| 2011/0149549 | A1 | 6/2011 | Miyake |
| 2015/0372200 | A1* | 12/2015 | Seko ..... H01L 33/504 362/510 |

FOREIGN PATENT DOCUMENTS

| | | | |
|---|---|---|---|
| JP | 2006-005367 | A | 1/2006 |
| JP | 2012-64484 | A | 3/2012 |

* cited by examiner

SEMICONDUCTOR LIGHT SOURCE APPARATUS

This application claims the priority benefit under 35 U.S.C. §119 of Japanese Patent Application No. 2013-007698 filed on Jan. 18, 2013, which is hereby incorporated in its entirety by reference.

BACKGROUND

1. Field

The presently disclosed subject matter relates to a semiconductor light source apparatus, and more particularly to a high power semiconductor light source apparatus including a phosphor layer, which can prevent a reduction of brightness absorbed by an adhesive material, and which can emit various color lights having a large amount of light intensity in order to be able to be used for general lighting, a stage light, a street light, a projector, etc.

2. Description of the Related Art

Semiconductor light source apparatuses that emit various color lights by combining a phosphor layer with a semiconductor light-emitting device such as an LED have been used for business machines, home electronics, audio instruments, etc. Recently, because brightness of the semiconductor light source apparatuses have improved, a range of application for the semiconductor light source apparatuses has expanded to fields such as general lighting, street lighting, a vehicle headlight, etc.

One method for improving the brightness of the semiconductor light source apparatuses including the phosphor layer, includes providing an excitation intensity of the phosphor layer that is enhanced by flowing a large current in the semiconductor light-emitting device. However, because heat occurs in the phosphor layer due to the large current, a transparent resin contained in the phosphor layer can be tarnished. Because the transparent resin is mixed with a phosphor in the phosphor layer, the tarnish of the transparent resin results in absorption of a part of light excited by the phosphor layer, and therefore may cause a reduction of the excitation intensity.

In addition, a reduction of a fluorescent intensity may be caused by a thermal quenching property of the phosphor layer due to the large current. The thermal quenching property is a phenomenon in which a fluorescent intensity of a phosphor becomes reduced when the phosphor is heated at a high temperature. Therefore, because the tarnish of the transparent resin and the reduction of the fluorescent intensity cause a reduction of a light-emitting intensity in semiconductor light source apparatuses that include a phosphor layer, it is difficult to improve the brightness of the semiconductor light source apparatuses by simply flowing a large current.

To improve such a problem, a semiconductor light source apparatus using a phosphor layer that includes a phosphor particle without a transparent resin is disclosed in Patent Document No. 1 (Japanese Patent Application Laid Open JP2012-064484). FIG. 5 is a schematic structural view showing a conventional semiconductor light source apparatus including a phosphor layer, which is disclosed in Patent Document No. 1.

The conventional semiconductor light source apparatus 20 includes a semiconductor light source 11; a phosphor ceramic layer 12 including a phosphor particle without a transparent resin; a light-reflecting substrate 13 mounting the phosphor ceramic layer 12 via an adhesive layer 14; and a lens 16 being located in a light-reflecting direction of a mixture light 15, in which a part of direct light emitted from the semiconductor light source 11 is mixed with a wavelength converted light through the phosphor ceramic layer 12 by an excitation light (another part of direct light) emitted from the semiconductor light source 11.

The phosphor ceramic layer 12 may not basically include a transparent resin, and therefore a tarnish of the phosphor ceramic layer 12 may not occur. In addition, because the phosphor ceramic layer 12 is made of a material having a low thermal sensitivity, a thermal quenching may be prevented. Consequently, it may be possible for this semiconductor light source apparatus to improve brightness by simply flowing a large current therethrough.

In the conventional semiconductor light source apparatus 20, the phosphor ceramic layer 12 is attached on the light-reflecting substrate 13 by the adhesive layer 14 such as an adhesive material, a metallic solder (e.g., silver solder), etc. The light-reflecting substrate 13 is operated as a reflective surface for the part of direct light emitted from the semiconductor light source 11 and the wavelength converted light through the phosphor ceramic layer 12 by the excitation light, a metallic heat sink for radiating heat generated from the phosphor ceramic layer 12, and an attachment member for attaching the phosphor ceramic layer 12.

Accordingly, when the phosphor ceramic layer 12 is attached on the light-reflecting substrate 13 by the adhesive material 14 such as a resin adhesive and the like, which have a low thermal conductivity as compared with a metallic material, the heat generated from the phosphor ceramic layer 12 may not radiate in an efficient manner. Especially, when the mixture light 15 having a high light-emitting brightness is emitted toward the lens 16 by entering a large amount of light such as a laser light into the phosphor ceramic layer 12, which is formed in a small shape, the phosphor ceramic layer 12 may break because the heat generated from the phosphor ceramic layer 12 cannot appropriately radiate from the light-reflecting substrate 13.

By contrast, when the phosphor ceramic layer 12 is attached on the light-reflecting substrate 13 by the metallic solder such as a silver solder, the solder material tends to easily spread toward a side surface of the phosphor ceramic layer 12. When the solder material spreads toward the side surface of the phosphor ceramic layer 12, because the solder material, which is attached to the side surface of the phosphor ceramic layer 12, may absorb light emitted from the side surface of the phosphor ceramic layer 12, said absorbed light may become a negative factor for reducing a light-emitting efficiency of the semiconductor light source apparatus 20.

The above-referenced Patent Documents and additional Patent Documents are listed below and are hereby incorporated with their English specification and abstracts in their entireties.

1. Patent document No. 1: Japanese Patent Application Laid Open JP2012-064484
2. Patent document No. 2: US Patent Publication No. US-2011-0116253 (ST3001-0274)
3. Patent document No. 3: U.S. patent application Ser. No. 12/972,056 (ST3001-0280)

The disclosed subject matter has been devised to consider the above and other problems, characteristics and features. Thus, an embodiment of the disclosed subject matter can include semiconductor light source apparatuses which can emit various color lights having high brightness, and which can efficiently radiate a high heat generated by a phosphor layer from a radiating substrate via metallic bumps, even when a high power semiconductor light-emitting device is used under a large current as a light source. In this case, light emitted from a high power semiconductor light-emitting device can be efficiently wavelength-converted by the phosphor layer without a reduction of light intensity, because the phosphor layer is directly disposed on a reflective layer contacting with the metallic bumps mounted on the radiating substrate and does not include a substantially resin component.

SUMMARY

The presently disclosed subject matter has been devised in view of the above and other characteristics, desires, and problems in the conventional art. An aspect of the disclosed subject matter can include providing a semiconductor light source apparatus having high brightness, which emits various color lights having a large amount of light intensity by reflecting on a reflective layer after entering light emitted from a light source into a phosphor layer, and which can radiate a high heat generated from the phosphor layer from a radiating substrate with high efficiency, via metallic bumps, which is located between the reflective layer and the radiating substrate. Thus, the semiconductor light source apparatus can be used for various lighting units such as a headlight, general lighting, a stage light, a street light, a projector, etc.

According to an aspect of the disclosed subject matter, a semiconductor light source apparatus can include: a radiating substrate having a bottom surface located in an opposite direction of a mounting surface; a phosphor layer having a top surface and a bottom surface being composed of at least one of a glass phosphor and a phosphor ceramic, and the top surface thereof including a light incident region; and a reflective layer being composed of at least one of a metallic reflective layer and an dielectric multi-layer, a top surface thereof directly contacting with the bottom surface of the phosphor layer, a bottom surface thereof including a heat-radiating region, the heat-radiating region of the reflective layer being located substantially just under the light incident region of the top surface of the phosphor layer.

In addition, the semiconductor light source apparatus can also include: a plurality of metallic bumps being located between the mounting surface of the radiating substrate and the bottom surface of the reflective layer, and thereby the phosphor layer being attached to the radiating substrate via the reflective layer; and a semiconductor light source being located adjacent to the phosphor layer, an optical axis thereof intersecting with the light incident region of the top surface of the phosphor layer at an angle between 0 degrees and 90 degrees, a light-emitting area thereof substantially corresponding to the light incident region on the top surface of the phosphor layer to wavelength-convert light emitted from the semiconductor light source by the phosphor layer, and wherein the semiconductor light source apparatus is configured such that light emitted from the semiconductor light source travelling along the optical axis changes direction toward the phosphor layer after being reflected from the reflective layer.

In the above-described exemplary light source apparatus, the plurality of metallic bumps can be located between the mounting surface of the radiating substrate and only the heat-radiating region of the bottom surface of the reflective layer, and also a locating density of the metallic bumps on the heat-radiating region of the bottom surface of the reflective layer is the highest on the bottom surface of the reflective layer to improve a heat radiating efficiency of the apparatus. The heat-radiating region of the reflective layer can be formed in at least one of a substantially circular shape having a maximum diameter of 1 millimeter, a substantially rectangular shape having a maximum side of 1 millimeter and a substantially ellipsoidal shape having a maximum length of the major axis of 1 millimeter to emit a large amount of mixture light with high efficiency. Additionally, each of the metallic bumps can be formed in a substantially spherical shape having a maximum diameter of 100 micro meters, each interval of the adjacent metallic bumps can be in range from 50 percents to 200 percents in the maximum diameter of the substantially spherical shape, and each of the metallic bumps can include at least one of gold, silver, copper, tin and lead in order to further improve the heat radiating efficiency in view of an economy of the apparatus.

Moreover, in the above-described exemplary light source apparatus, the phosphor layer can consist essentially of at least one of a glass phosphor and a phosphor ceramic which includes substantially no resin component, and also the apparatus can further include an encapsulating resin being disposed between the radiating substrate and the reflective layer while surrounding each of the metallic bumps, wherein the encapsulating resin includes at least one of a transparent silicone resin, a white silicon resin and a transparent glass, so as to be able to emit the mixture light having a high light-intensity without a reduction of light intensity. The metallic reflective layer of the reflective layer can include at least one of silver, platinum, gold, copper, titanium and silicon, and the dielectric multi-layer of the reflective layer can include at least one of $SiO_2$, $Al_2O_3$, $TiO_2$ and ZnO to enhance features the phosphor layer and the metallic bumps.

Furthermore, in the above-described exemplary light source apparatus, the light source apparatus can further include a heat sink fin extending in an opposite direction of the metallic bumps from the bottom surface of the radiating substrate to enhance the radiating efficiency thereof. The semiconductor light source can be a blue light-emitting device and the phosphor layer can be one of a yellow phosphor glass and a yellow phosphor ceramic so that the light source apparatus can emit the mixture light having a substantially white color tone. The semiconductor light source can be an ultraviolet light-emitting device and the phosphor layer can include at least one of a red phosphor, a green phosphor and a blue phosphor so that the semiconductor light source apparatus can emit various color lights having a high brightness.

According to the above-described exemplary semiconductor light source apparatuses, even when a high power semiconductor light-emitting device is used under a large current as the semiconductor light source, light emitted from the high power semiconductor light-emitting device can be efficiently wavelength-converted by the phosphor layer without a reduction of light intensity, because the phosphor layer is directly located on the reflective layer contacting with the metallic bumps, which can efficiently conduct the heat generated from the phosphor layer to the radiating substrate. Thus, the semiconductor light source apparatuses can emit various color lights having high brightness including white light, as described above, and therefore can be used for various lighting units such as a headlight, general lighting, a stage light, a street light, a projector, etc.

BRIEF DESCRIPTION OF THE DRAWINGS

These and other characteristics and features of the disclosed subject matter will become clear from the following description with reference to the accompanying drawings, wherein.

DETAILED DESCRIPTION OF EXEMPLARY EMBODIMENTS

Figure 1:
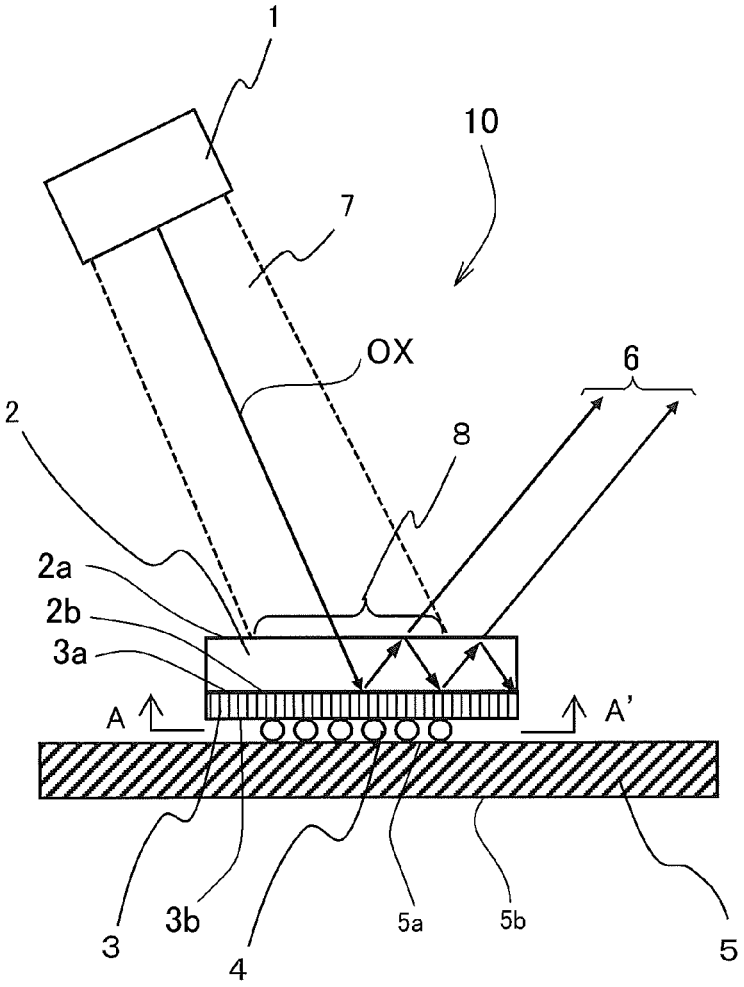
FIG. 1 is a schematic structural view showing an exemplary embodiment of a semiconductor light source apparatus made in accordance with principles of the disclosed subject matter.

The disclosed subject matter will now be described in detail with reference to FIG. 1 to FIG. 4, in which the same or corresponding elements use the same reference marks. FIG. 1 is a schematic structural view showing an exemplary embodiment of a semiconductor light source apparatus made in accordance with principles of the disclosed subject matter.

A semiconductor light source apparatus 10 can include a semiconductor light source 1 having an optical axis OX being configured to emit light having a light-emitting wavelength from an ultraviolet light to a visible light from a light-emitting area 7 including the optical axis OX, and a phosphor layer 2 having a top surface 2*a* and a bottom surface 2*b* including at least one phosphor to wavelength-convert the light emitted from the light-emitting area 7 of the semiconductor light source 1 into an excited light having a longer light-emitting wavelength than that of the light emitted from the semiconductor light source 1, being located away from the semiconductor light source 1, the top surface thereof including a light incident region 8 to receive the light from the light-emitting area 7 of the semiconductor light source 1, and therefore the light-emitting area 7 of the semiconductor light source 1 substantially corresponding to the light incident region 8 on the top surface 2*a* of the phosphor layer 2, the optical axis OX of the semiconductor light source 1 intersecting with the light incident region 8 on the top surface 2*a* of the phosphor layer 2 at an angle between 0 degrees and 90 degrees.

The semiconductor light source apparatus 10 can also include: a reflective layer 3 having a top surface 3*a* and a bottom surface 3*b*, the top surface 3*a* thereof directly contacting with the bottom surface 2*b* of the phosphor layer 2, and therefore no material such as an adhesive material being disposed between the top surface 3*a* of the reflective layer 3 and the bottom surface 2*b* of the phosphor layer 2, the bottom surface 3*b* of the reflective layer 3 including a heat-radiating region 3H (as described later in FIG. 2*a* to FIG. 2*c*), the heat-radiating region 3H on the bottom surface 3*b* of the reflective layer 3 being located substantially just under the light incident region 8 on the top surface 2*a* of the phosphor layer 2, and wherein the semiconductor light source apparatus 10 can be configured such that the light emitted from the light-emitting area 7 of the semiconductor light source 1 travelling along the optical axis OX changes direction toward the phosphor layer 2 after being reflected from the reflective layer 3; and a plurality of metallic bumps 4 being located between the bottom surface 3*b* of the reflective layer 3 and a radiating substrate 5, which can be used as an attachment member for the phosphor layer 2 and the reflective layer 3 via the metallic bumps 4, and which can efficiently radiate heat generated from the phosphor layer 2 via the reflective layer 3 and the metallic bumps 4.

Accordingly, a part of the light emitted from the light-emitting area 7 of the semiconductor light source 1 can be wavelength-converted by the phosphor layer 2 including at least one phosphor, and said wavelength converted light can be mixed with another part of the direct light, which is not wavelength-converted in the phosphor layer 2. Thereby, the semiconductor light source apparatus 10 can emit a mixture light 6 having a wavelength, which is different from a wavelength of the light emitted from the semiconductor light source 1, in a direction toward a prescribed light-emission of the semiconductor light source apparatus 10.

The plurality of metallic bumps 4 can be located within a range of the heat-radiating region 3H on the bottom surface 3*b* of the reflective layer 3, where is located just under the light incident region 8 on the top surface 2*a* of the phosphor layer 2. The light incident region 8 of the phosphor layer 2 can receive the light emitted from the semiconductor light source 7, and the light can enter into the phosphor layer 2 from the light incident region 8 on the top surface 2*a* of the phosphor layer 2. Accordingly, although heat generated from the phosphor layer 2 by the light emitted from the light-emitting area 7 of the semiconductor light source 1 may make a high temperature from the light incident region 8 of the top surface 2*a* of the phosphor layer 2 toward the metallic bumps 4, which are mounted on a mounting surface 5*a* of the radiating substrate 5, the radiating substrate 5 having a bottom surface 5*b* can efficiently radiate the heat generated from the phosphor layer 2 via the metallic bumps 4, which are located within the range of the heat-radiating region 3H of the bottom surface 3*b* of the reflective layer 3 that is located just under the light incident region 8 of the phosphor layer 2.

The metallic bumps 4 cannot be melted by the heat conducted from the reflective layer 3 to the radiating substrate 5 because the metallic bumps 4 have a high melting point. Therefore, because the metallic bump 4 cannot drag toward a side surface of the phosphor layer 2 and also can separate from a side surface of the reflective layer 3 as shown in FIG. 1, the metallic bump 4 cannot cause a degradation of optical characteristics of the semiconductor light source apparatus 10.

In addition, a structure of the disclosed subject matter can maintain a high heat-radiating efficiency, and therefore can also concentrate a large amount of the light from the light-emitting area 7 on the light incident region 8, which is formed in various small shapes. Thus, the semiconductor light source apparatus 10 can emit the mixture light 6 having a high brightness and various color tones as a reflective typed semiconductor light source apparatus using the reflective layer 3, by mixing the wavelength converted light by the part of the large amount of the light with the other part of the large amount of the light, which is not wavelength-converted in the phosphor layer 7.

Figure 2A:
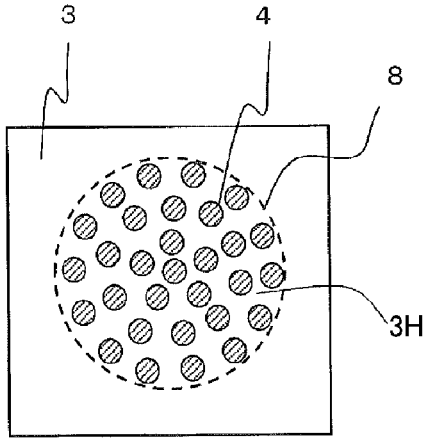
FIG. 2*a* is an exemplary cross-sectional view showing locations of metallic bumps of the semiconductor light source apparatus taken along line A-A' shown in FIG. 1, wherein an exemplary shape of a heat-radiating region of a reflective layer is formed in a substantially circular shape.
Figure 2B:
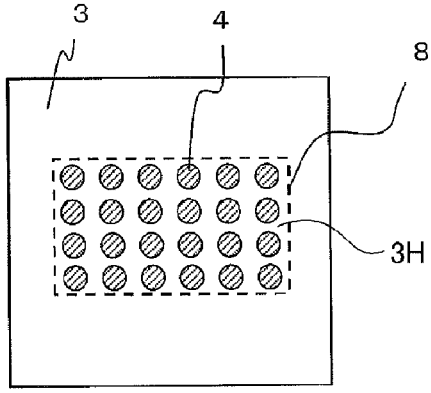
FIG. 2*b* is an exemplary cross-sectional view showing locations of metallic bumps of the semiconductor light source apparatus taken along line A-A' shown in FIG. 1, wherein an exemplary shape of a heat-radiating region of a reflective layer is formed in a substantially rectangular shape.
Figure 2C:
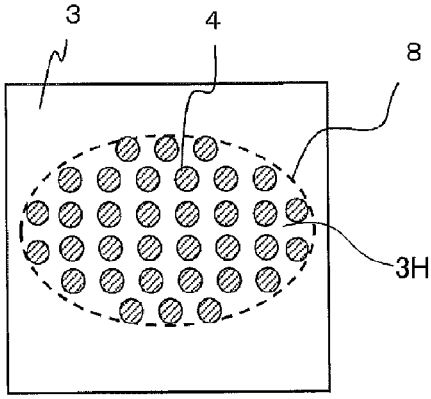
FIG. 2*c* is an exemplary cross-sectional view showing locations of metallic bumps of the semiconductor light source apparatus taken along line A-A' shown in FIG. 1, wherein an exemplary shape of a heat-radiating region of a reflective layer is formed in a substantially ellipsoidal shape.
Figure 2D:
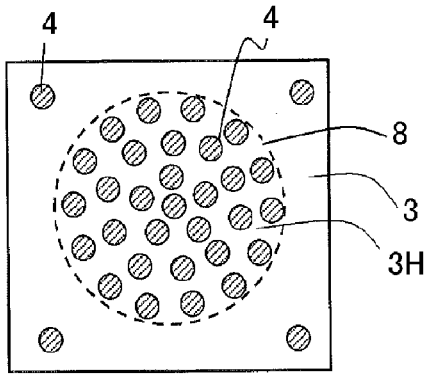
FIG. 2*d* is an exemplary cross-sectional view showing locations of metallic bumps of the semiconductor light source apparatus taken along line A-A' shown in FIG. 1, wherein exemplary shape of a heat-radiating region of a reflective layer is formed in another substantially circular shape.

FIGS. 2*a* to 2*c* are cross-sectional views showing exemplary locations of the metallic bumps 4 of the semiconductor light source apparatus taken along line A-A' shown in FIG. 1, wherein the heat-radiating region 3H are formed in a substantially circular shape, a substantially rectangular shape and a substantially ellipsoidal shape. In these cases, each of the bumps 4 can located within the range of the heat-radiating region 3H on the bottom surface 3*b* of the reflective layer 3, which is located substantially just under the radiating region 8 on the top surface 2*a* of the phosphor layer 2.

However, at least one of the metallic bumps 4 may be located out of range of the heat-radiating region 3H on the bottom surface 3*b* of the reflective layer 3, for example, each of additional four metallic bumps can be located at a respective one of four corners so that the phosphor layer 2 can be attached on the radiating substrate 5 under a stable state via the metallic bumps 4, as shown in FIG. 2*b*. In this case, a locating density of the metallic bumps 4, which is located within the range of the heat-radiating region 3H of the bottom surface 3*b* of the reflective layer 2 that is located just under the radiating region 8 on the top surface 2*a* of the phosphor layer 2, can be higher than that of the additional metallic bumps, which are located out of the range of the heat-radiating region 3H of the bottom surface 3*b* of the reflective layer 3. Accordingly, the locating density of the metallic bumps 4 on the heat-radiating region 3H on the bottom surface 3*b* of the reflective layer 3 can be the highest on the bottom surface 3*b* of the reflective layer 3.

Thereby, the semiconductor light source apparatus 10 can efficiently conduct the high heat generated from the radiating region 8 on the top surface 2*a* of the phosphor layer 2 by the light emitted from the of the light-emitting area 7 of the semiconductor light source 1, from the phosphor layer 2 to the radiating substrate 5 via the reflective layer 3 and the metallic bumps 4, and also radiate the above high heat from the radiating substrate 5 with high efficiency. Therefore, the semiconductor light source apparatus 10 can prevent the phosphor layer 2 from a quenching, a cracking, a breaking and the like caused by the high heat generated from the phosphor layer 2.

Figure 3:
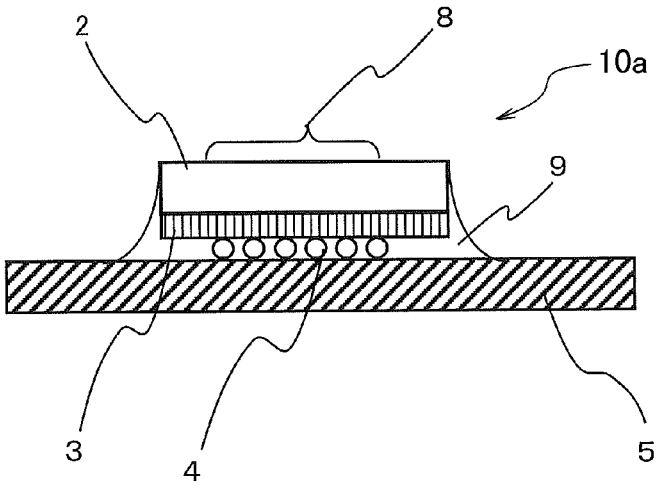
FIG. 3 is a schematic structure depicting a principal part of an exemplary variation of the semiconductor light source apparatus shown in FIG. 1.

As an exemplary variation of the semiconductor light source apparatus 10 will now be described with reference to FIG. 3. The semiconductor light source apparatus 10*a* can further include an encapsulating resin 9, which is disposed between the radiating substrate 5 and the reflective layer 3 while surrounding each of the metallic bumps 4. The encapsulating resin 9 can result in further improving an adhesion and the heat-conductivity between the radiating substrate 5 and the reflective layer 3.

The encapsulating resin 9 can be used as a white resin material having a high reflectivity or a transparent resin material having a high thermal resistance such as a silicone series resin, a hybrid resin including a filler, etc. When the encapsulating resin 9 having a high reflectivity covers a side surface of the phosphor layer 2, the semiconductor light source apparatus 10*a* can improve a light-emitting efficiency by reflecting a part of the mixture light 6, which moves toward the side surface of the phosphor layer 2, toward the top surface 2*a* of the phosphor layer 2 by using the encapsulating resin 9. Thus, the semiconductor light source apparatus 10*a* can emit the mixture light 6 having a high light-intensity without a reduction of light intensity in addition to an increase of the adhesion between the radiating substrate 5 and the reflective layer 3.

Next, each of elements of the above-described embodiments will now be explained in detail. As the semiconductor light source 1, an LED of GaN series that emits blue light having a light-emitting wavelength of approximately 460 nanometers can be used, and also a laser diode that emits blue light having a light-emitting wavelength of approximately 460 nanometers, and which emits an ultraviolet light having a light-emitting wavelength of approximately 300 nanometers to 400 nanometers, can be used. Each of light-emitting intensities of the LED and the laser diode can be employed in accordance with a desired light-emitting intensity of the semiconductor light source apparatuses 10 and 10*a*.

As a phosphor contained in the phosphor layer 2, at least one phosphor, which wavelength-converts the light emitted from the light-emitting area 7 of the semiconductor light source 1 into the excited light having a longer light-emitting wavelength than that of the light emitted from the semiconductor light source 1 by absorbing the light having a light-emitting wavelength from the ultraviolet light to the blue light, can be used.

For example, $CaAlSiN_3$: $Eu^{2+}$, (Ca, Sr) $AlSiN_3$: $Eu^{2+}$, $Ca_2Si_5N_8$: $Eu^{2+}$, $(Ca, Sr)_2Si_5N_8$: $Eu^{2+}$, $KSiF_6$: $Mn^{4+}$, $KTiF_6$: $Mn^{4+}$ and the like can be used as a red phosphor of the phosphor layer 2. As an yellow phosphor, $Y_3Al_5O_{12}$: $Ce^{3+}$ (YAG), $(Sr, Ba)_2$ $SiO_4$: $Eu^{2+}$, $Ca_x(Si, Al)_{12}$ $(O, N)_{16}$: $Eu^{2+}$ and the like can be used. $Lu_3Al_5O_{12}$: $Ce^{3+}$, $Y_3(Ga, Al)_5$ $O_{12}$: $Ce^{3+}$, $Ca_3Sc_2Si_3O_{12}$: $Ce^{3+}$, $CaSc_2O_4$: $Eu^{2+}$, $(Ba, Sr)_2SiO_4$: $Eu^{2+}$, $Ba_3Si_6O_{12}N_2$: $Eu^{2+}$, $(Si, Al)_6(O, N)_8$: $Eu^{2+}$ and the like can be used as a green phosphor. $(Sr, Ca, Ba, Mg)_{10}(PO_4)_6C_{12}$: $Eu^{2+}$, $BaMgAl_{10}O_{17}$: $Eu^{2+}$, $LaAl(Si, Al)_6(N, O)_{10}$: $Ce^{3+}$ can be used as a blue phosphor.

As the phosphor layer 2 that disperses the phosphor powder in the glass, a glass phosphor that disperses each phosphor powder of the above-described phosphors in a glass including an oxide component such as $P_2O_3$, $SiO_2$, $B_2O_3$, $Al_2O_3$ and the like can be used. As the phosphor layer 2 that adds a light-emitting ion into the glass, a nitride glass phosphor that adds an activator such as $Ce^{3+}$ and $Eu^{2+}$ in a nitride glass such Ca—Si—Al—O—N series, Y—Si—Al—O—N series and the like can be used.

The phosphor ceramic can be made by forming the above phosphor in a predetermined shape (e.g., 1 to several square millimeters) and by burning the phosphor. In the case, even when an organic material is used as a binder in a manufacturing process for the phosphor layer 2, because the organic component is burnt in a degreasing process after the forming process, the phosphor ceramic can include only the resin component of 5 wt percentages or less. Therefore, the phosphor ceramic, which is used as the phosphor layer 2, can include substantially no resin component.

As described above, the phosphor layer 2 does not include a substantially resin component, or includes no resin component. Therefore, a tarnish of the phosphor layer 2 cannot be caused by radiating the heat generated from the phosphor layer 2 from the radiating substrate 5 via the reflective layer 3 and the metallic bumps 4, even if the phosphor layer 2 generates a large amount of radiating heat due to a large amount of the light emitted from the light-emitting area 7. Accordingly, the semiconductor light source apparatus 10 that can emit the mixture light 6 having high brightness can be realized. The phosphor layer 2 that does not include a substantial amount of a resin component means that the resin component for forming the phosphor layer 2 is, for example, 5 wt percentages or less in the phosphor layer 2.

As indicated above, the phosphor layer 2 can consist essentially of (or consist of) at least one of a glass phosphor and a phosphor ceramic. Thus, in the phosphor layer 2 which does not include a substantial resin component, a tarnish of the phosphor layer 2 by a radiating heat can be prevented. The phosphor layer 2 can be made by dispersing a phosphor powder in a glass, and also a glass phosphor that adds the light-emitting ion into a glass and a phosphor ceramic that is composed of a single crystal phosphor or a poly crystal phosphor can be used as the phosphor layer 2.

Therefore, because the above-described phosphor layer 2 does not include a substantial resin component and can be composed of only inorganic materials, the tarnish is prevented in the phosphor layer 2. In addition, the glass phosphor can have a high thermal conductivity in general, and therefore the radiating efficiency of the phosphor layers 2 that is composed of the glass phosphor can become high. Moreover, because the phosphor ceramic can generally have a higher thermal conductivity than that of the glass phosphor and a manufacturing cost for the poly crystal phosphor ceramic may be lower than that for the single crystal phosphor ceramic, the poly crystal phosphor ceramic can be used as the phosphor layer 2.

The phosphor layer 2 can include at least one phosphor that wave-converts the light emitted from the light-emitting area 7 of the semiconductor light source 1 into light having a prescribed wavelength. For example, when the phosphor layer 2 includes a red phosphor wavelength-converting ultraviolet light into red light, a green phosphor wavelength-converting the ultraviolet light into green light and a blue phosphor wavelength-converting the ultraviolet light into blue light and when the semiconductor light source 1 emits the ultraviolet light, the semiconductor light source apparatus 10 can emit substantially white light as the mixture light 6 due to an additive color mixture using lights excited by the three phosphors.

When the phosphor layer 2 includes a red phosphor wavelength-converting blue light into purple light and a green phosphor wavelength-converting the blue light into blue-green light and when the semiconductor light source 1 emits the blue light, the semiconductor light source apparatus 10 can also emit substantially white light as the mixture light 6 due to an additive color mixture using lights excited by the two phosphors and a part of the blue light that is not excited by the phosphors.

In addition, when the phosphor layer 2 includes a yellow phosphor wavelength-converting the blue light into yellow light and when the semiconductor light source 1 emits the blue light, the semiconductor light source apparatus 10 can emit substantially white light as the mixture light 6 due to an additive color mixture using light excited by the yellow phosphor and a part of the blue light that is not excited by the yellow phosphor.

The phosphor ceramic can be manufactured in order of a mixing process of raw materials, a forming process, a burning process and a fabricating process. When a phosphor ceramic of YAG phosphor for the yellow phosphor is produced, oxides of constituent element of YAG phosphor such as yttrium oxide, cerium oxide, alumina, etc. and carbonate, nitrate salt, hydrosulfate and the like that become an oxide after the burning can be used as raw materials so that each of the raw materials becomes a stoichiometric proportion with respect to each other.

In this case, a chemical compound of calcium, silicon and the like can be added for the purpose of an improvement of transmission of the phosphor ceramic after the burning. The raw materials can be dispersed in water or an organic solvent and can be mixed by a wet ball mill. Next, the mixed raw materials can be formed in a predetermined shape. A uniaxial pressure method, a cold isostatic pressure method, a slip casting method, a mold injection and the like can be used as the forming method. The transparent YAG phosphor ceramic can be produced by burning the formed material at 1,600 to 1,800 degrees centigrade.

The above-described phosphor ceramic can be polished by polishing equipment so as to have a thickness of several multiples of ten micrometers to several hundred micrometers, a plate such as a round shape, a square shape, a fan shape, a rig shape and the like can be cut off by a scriber, dicer, etc. The phosphor ceramic can have a high thermal conductivity, and therefore can easily conduct the heat generated from the phosphor layer 2 to the reflective layer 3 so that the radiating substrate 5 can radiate the heat generated from the phosphor layer 2 with high efficiency via the metallic bumps 4.

As the radiating substrate 5, an oxide ceramic, a non-oxide ceramic, a metallic plate and the like can be used. Especially, a metallic plate having a high reflectivity can be used, to provide a high thermal conductivity and a high workability to the radiating substrate 6. As the metallic plate of the radiating substrate 5, Al, Cu, Ti, Si, Ag, Au, Ni, Mo, W, Fe, Pd and the like and an alloy including at least one of the above-described metallic elements can be used. The radiating substrate 5 can be provided with a heat sink fin 5c to improve the radiating efficiency, as described later with reference to FIG. 4.

The reflective layer 3 can operate as a reflector that reflects the mixture light 6 mixed in the phosphor layer 2, and also can operate as a conductor, which conducts the heat generated from the phosphor layer 2 to the metallic bumps 4. Accordingly, a metallic reflective layer such as silver or silver alloys, platinum, gold, copper, titanium, silicon, and the like and an dielectric multi-layer such as $SiO_2$, $Al_2O_3$, $TiO_2$, ZnO and the like can be used as the reflective layer 3. A layer having a high reflectivity can be directly formed on the bottom surface 2*b* of the phosphor layer 2, and another layer having a high thermal conductivity can be formed on the layer having the high reflectivity, because the reflective layer 3 can efficiently operate as both the reflector and the conductor.

In these case, the reflectively layer 3 on the bottom surface 2*b* of the phosphor layer 2 can be directly formed by a vacuum vapor deposition method, a spattering method, a plating method, a high-melting-point metal method, etc. The high-melting-point metal method is a forming method, in which an organic binder including a metallic particle is applied on the surface of the phosphor ceramic and is heated at 1,000 to 1,700 degrees centigrade under a reductive atmosphere including water vapor and mercury. In this case, Si, Nb, Ti, Zr, Mo, Ni, Mn, W, Fe, Pt, Al, Au, Pd, Ta, Cu and an alloy including at least one of the metallic elements can be used as the metallic layer. As the metal brazing material, a brazing material including Ag, Cu, Zn, Ni, Sn, Ti, Mn, In, Bi and the like can be used.

The heat-radiating region 3H of the bottom surface 3*b* of the reflective layer 3 can be formed in at least one of a substantially circular shape having a maximum diameter of 1 millimeter, a substantially rectangular shape having a maximum side of 1 millimeter and a substantially ellipsoidal shape having a maximum length of the major axis of 1 millimeter in order to be able to emit a large amount of mixture light 6 with high efficiency.

As the metallic bumps 4, a metallic having a high thermal conductivity such that includes at least one of gold, silver, copper, tin and lead can be employed. The metallic bumps 4 can efficiently conduct the heat generated from the phosphor layer 2 to the radiating substrate 5 by intensively locating them on the heat-radiating region 3H of the bottom surface 3*b* of the reflective layer 3, which substantially corresponds to the light incident region 8 on the top surface 2*a* of the phosphor layer 2.

Each of the metallic bumps 4 can be formed in a substantially spherical shape having a maximum diameter of 100 micro meters, and each diameter of the metallic bumps 4 can be several micro meters or so. Each interval of the adjacent metallic bumps 4 can be in range from 50 percents to 200 percents in the maximum diameter of the substantially spherical shape, and can be approximately several micro meters when each diameter of the metallic bumps 4 is several micro meters.

When the encapsulating resin 9 is disposed around the metallic bumps 4, a transparent material such as a transparent silicon resin, a transparent liquid glass and the like, and a reflective material having a high reflectivity such as a white silicone resin and the like can be used as the encapsulating resin 9.

Figure 4:
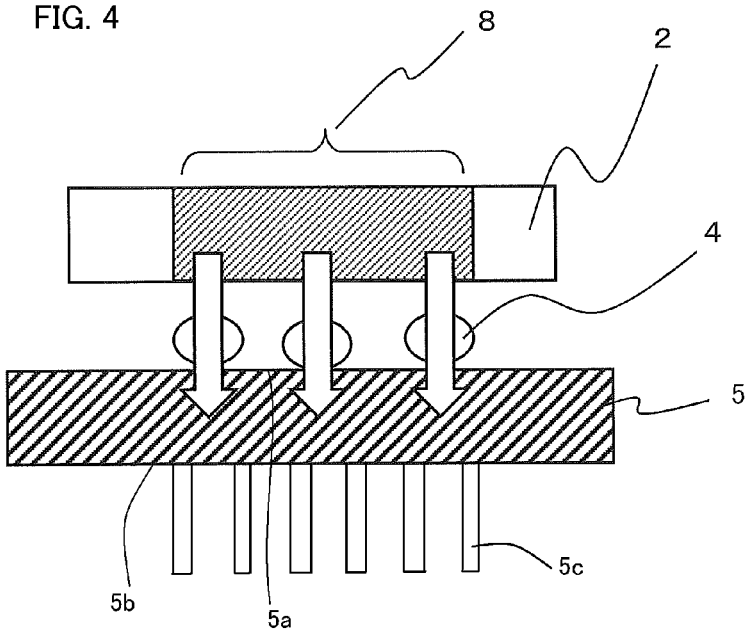
FIG. 4 is an explanatory view depicting an exemplary thermal conductive path of the semiconductor light source apparatuses shown in FIG. 1 and FIG. 3.
Figure 5:
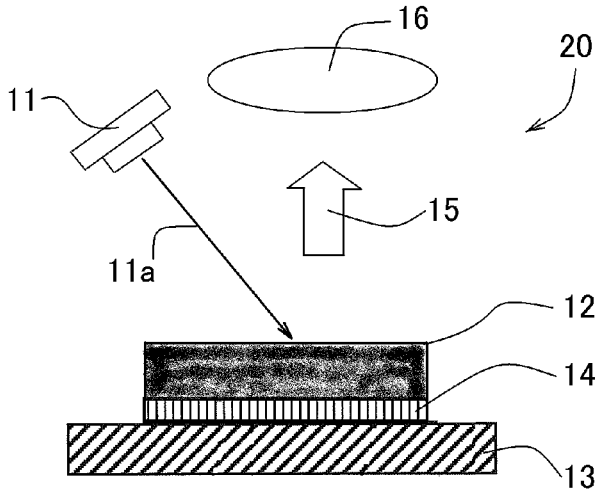
FIG. 5 Conventional Art
FIG. 5 is a schematic structural view showing a conventional semiconductor light source apparatus using a phosphor ceramic layer, which includes a phosphor particle without a transparent resin.

FIG. 4 is an explanatory view depicting an exemplary thermal conductive path of the embodiments of the semiconductor light source apparatus described above, wherein the reflective layer 3 located underneath the bottom surface 2*b* of the phosphor layer 2 is abbreviated to fascinate the understanding of the thermal conductive path. A temperature may rise on a portion of the bottom surface 2*b* located just under the light incident region 8, where enters the light emitted from the light-emitting area 7 of the semiconductor light source 1.

However, said head, which rise in temperature, can efficiently radiate from the radiating substrate 5 via the metallic bumps 4, which are located just under the light incident region 8. The metallic bumps 4 can conduct the heat from the light incident region 8 to the radiating substrate 5, which can include the heat sink fin 5*c* in an opposite direction of the mounting surface 5*a* of the radiating substrate 5 from the bottom surface 5*b*, through the shortest thermal conductive path as shown in FIG. 4. Thus, the embodiments of the disclosed subject matter can maintain a high thermal-radiating efficiency.

As described above, the phosphor layer 2 can include at least one of the red phosphor, the green phosphor, the blue phosphor and the yellow phosphor, and the semiconductor light source 1 can emit at least one of the ultraviolet light and the blue light from the light-emitting area 7. Accordingly, the semiconductor light source devices 10 and 10*a* can emit various color lights by combining the phosphor layer 2 with the semiconductor light source 1. In addition, because the phosphor layer 2 cannot include the substantially resin component and can be efficiently radiated from the radiating substrate 5 via the reflective layer 3 contacting with the phosphor layer 2 and the metallic bumps 4, a high power semiconductor light source such as a laser diode can be used under a large current as the semiconductor light source 1. Thus, the disclosed subject matter can provide semiconductor light source apparatuses that can emit various color lights having a large amount of light intensity.

Moreover, the metallic bumps 4 cannot be melted by the heat conducted from the reflective layer 3 to the radiating substrate 5 because of their high melting point, and also can separate from the side surface of the reflective layer 3. Accordingly, because the metallic bump 4 cannot drag toward the side surface of the phosphor layer 2, the semiconductor light source apparatuses 10 and 10*a* of the disclosed subject matter cannot cause the degradation of the optical characteristics thereof by using the metallic bumps 4.

Furthermore, when an optical axis of the mixture light 6, in which the optical axis OX of the semiconductor light source 1 is reflected by the reflective layer 3, corresponds to a substantially optical axis of an additional zoom lens, because a lighting unit including the zoom lens can provide a favorable light distribution in focus, the lighting unit combining each of the semiconductor light source apparatuses 10 and 10*a* with the zoom lens can be used for a lighting system having a zoom function such as a projector, stage lighting, etc. Thus, the disclosed subject matter can provide high power light source apparatuses having high brightness and favorable light distributions by using a high power semiconductor light source, which can be used for various lighting units such as a headlight, a projector, a stage lighting, general lighting, a street lighting, etc.

Various modifications of the above disclosed embodiments can be made without departing from the spirit and scope of the presently disclosed subject matter. For example, cases where the above-described phosphor layer and the reflective layer are formed in the substantially rectangular shape are described. However, the phosphor layer cannot be limited to this shape and can be formed in various shapes such as a circular shape, an ellipsoidal shape and the like. In addition, the specific arrangement between components can vary between different applications, and several of the above-described features can be used interchangeably between various embodiments depending on a particular application of the semiconductor light source apparatus.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. A semiconductor light source apparatus, comprising:

a radiating substrate having a mounting surface and a bottom surface located in an opposite direction of the mounting surface;

a phosphor layer having a top surface and a bottom surface being composed of at least one of a glass phosphor and a phosphor ceramic, and the top surface of the phosphor layer including a light incident region;

a reflective layer having a top surface and a bottom surface being composed of at least one of a metallic reflective layer and an dielectric multi-layer, the top surface of the reflective layer directly contacting with the bottom surface of the phosphor layer, the bottom surface of the reflective layer including a heat-radiating region, the heat-radiating region of the bottom surface of the reflective layer being located substantially under the light incident region of the top surface of the phosphor layer;

a plurality of metallic bumps being located between the mounting surface of the radiating substrate and the bottom surface of the reflective layer including the heat-radiating region, and thereby the phosphor layer being attached to the radiating substrate via the reflective layer; and a semiconductor light source having an optical axis and a light-emitting area, the semiconductor light source located adjacent to the phosphor layer, the optical axis of the semiconductor light source intersecting with the light incident region of the top surface of the phosphor layer at an angle between 0 degrees and 90 degrees, the light-emitting area of the semiconductor light source substantially corresponding to the light incident region on the top surface of the phosphor layer to wavelength-convert light emitted from the semiconductor light source by the phosphor layer, and wherein the semiconductor light source apparatus is configured such that light emitted from the semiconductor light source travelling along the optical axis changes direction toward the phosphor layer after being reflected from the reflective layer.

2. The semiconductor light source apparatus according to claim 1, wherein the plurality of metallic bumps is located between the mounting surface of the radiating substrate and only the heat-radiating region of the bottom surface of the reflective layer.

3. The semiconductor light source apparatus according to claim 1, wherein a locating density of the metallic bumps on the heat-radiating region of the bottom surface of the reflective layer is the highest on the bottom surface of the reflective layer.

4. The semiconductor light source apparatus according to claim 1, wherein the heat-radiating region of the bottom surface of the reflective layer is formed in at least one of a substantially circular shape having a maximum diameter of 1 millimeter, a substantially rectangular shape having a maximum side of 1 millimeter and a substantially ellipsoidal shape having a maximum length of the major axis of 1 millimeter.

5. The semiconductor light source apparatus according to claim 2, wherein the heat-radiating region of the bottom surface of the reflective layer is formed in at least one of a substantially circular shape having a maximum diameter of 1 millimeter, a substantially rectangular shape having a maximum side of 1 millimeter and a substantially ellipsoidal shape having a maximum length of the major axis of 1 millimeter.

6. The semiconductor light source apparatus according to claim 1, wherein each of the metallic bumps is formed in a substantially spherical shape having a maximum diameter of 100 micro meters, and each interval of the adjacent metallic bumps is in range from 50 percents to 200 percents in the maximum diameter of the substantially spherical shape.

7. The semiconductor light source apparatus according to claim 2, wherein each of the metallic bumps is formed in a substantially spherical shape having a maximum diameter of 100 micro meters, and each interval of the adjacent metallic bumps is in range from 50 percents to 200 percents in the maximum diameter of the substantially spherical shape.

8. The semiconductor light source apparatus according to claim 1, wherein each of the metallic bumps includes at least one of gold, silver, copper, tin and lead.

9. The semiconductor light source apparatus according to claim 2, wherein each of the metallic bumps includes at least one of gold, silver, copper, tin and lead.

10. The semiconductor light source apparatus according to claim 1, wherein the phosphor layer consists essentially of at least one of a glass phosphor and a phosphor ceramic which includes substantially no resin component.

11. The semiconductor light source apparatus according to claim 2, wherein the phosphor layer consists essentially of at least one of a glass phosphor and a phosphor ceramic which includes substantially no resin component.

12. The semiconductor light source apparatus according to claim 1, further comprising:

an encapsulating resin being disposed between the radiating substrate and the reflective layer while surrounding each of the metallic bumps, and wherein the encapsulating resin includes at least one of a transparent silicone resin, a white silicon resin and a transparent glass.

13. The semiconductor light source apparatus according to claim 2, further comprising:

an encapsulating resin being disposed between the radiating substrate and the reflective layer while surrounding each of the metallic bumps, and wherein the encapsulating resin includes at least one of a transparent silicone resin, a white silicon resin and a transparent glass.

14. The semiconductor light source apparatus according to claim 1, wherein the metallic reflective layer of the reflective layer includes at least one of silver, platinum, gold, copper, titanium and silicon, and the dielectric multi-layer of the reflective layer includes at least one of $SiO_2$, $Al_2O_3$, $TiO_2$ and ZnO.

15. The semiconductor light source apparatus according to claim 2, wherein the metallic reflective layer of the reflective layer includes at least one of silver, platinum, gold, copper, titanium and silicon, and the dielectric multi-layer of the reflective layer includes at least one of $SiO_2$, $Al_2O_3$, $TiO_2$ and ZnO.

16. The semiconductor light source apparatus according to claim 1, further comprising:

a heat sink fin extending in an opposite direction of the metallic bumps from the bottom surface of the radiating substrate.

17. The semiconductor light source apparatus according to claim 2, further comprising:

a heat sink fin extending in an opposite direction of the metallic bumps from the bottom surface of the radiating substrate.

18. The semiconductor light source apparatus according to claim 1, wherein the semiconductor light source is a blue light-emitting device and the phosphor layer is one of a yellow phosphor glass and a yellow phosphor ceramic.

19. The semiconductor light source apparatus according to claim 1, wherein the semiconductor light source is a blue light-emitting device and the phosphor layer is one of a phosphor glass and a phosphor ceramic, which include two phosphors of a red phosphor and a green phosphor.

20. The semiconductor light source apparatus according to claim 1, wherein the semiconductor light source is an ultraviolet light-emitting device and the phosphor layer includes at least one of a red phosphor, a green phosphor and a blue phosphor.

* * * * *